US008434333B2

(12) United States Patent
Zhang et al.

(10) Patent No.: US 8,434,333 B2
(45) Date of Patent: May 7, 2013

(54) TRI-LAYER KNIT FABRIC, THERMAL PROTECTIVE MEMBERS FORMED THEREFROM AND METHODS OF CONSTRUCTION THEREOF

(75) Inventors: Zhong Huai Zhang, Pottstown, PA (US); Philip E. Marks, Chester Springs, PA (US); Linwood Ludy, Pottstown, PA (US)

(73) Assignee: Federal-Mogul Powertrain, Inc., Southfield, MI (US)

( * ) Notice: Subject to any disclaimer, the term of this patent is extended or adjusted under 35 U.S.C. 154(b) by 153 days.

(21) Appl. No.: 12/838,816

(22) Filed: Jul. 19, 2010

(65) Prior Publication Data

US 2011/0162126 A1 Jul. 7, 2011

Related U.S. Application Data

(60) Provisional application No. 61/226,350, filed on Jul. 17, 2009.

(51) Int. Cl.
*D04B 7/34* (2006.01)

(52) U.S. Cl.
USPC ..... 66/174; 66/193; 66/195

(58) Field of Classification Search ..... 66/196, 66/193, 195, 202, 174; 442/318
See application file for complete search history.

(56) References Cited

U.S. PATENT DOCUMENTS 299,017 A * 5/1884 Schenck et al. ..... 285/258
610,463 A * 9/1898 Stowe ..... 139/388
4,576,081 A * 3/1986 Felthuis et al. ..... 87/6
4,681,783 A * 7/1987 Hyodo et al. ..... 428/36.1
4,785,558 A * 11/1988 Shiomura ..... 36/114
4,787,219 A * 11/1988 Sato et al. ..... 66/190
5,183,079 A * 2/1993 Blin ..... 138/110
5,273,080 A * 12/1993 Morohashi et al. ..... 139/388
5,385,036 A * 1/1995 Spillane et al. ..... 66/87
5,395,684 A * 3/1995 Robinson et al. ..... 442/312
5,422,153 A * 6/1995 Miyamoto ..... 428/95
5,727,401 A * 3/1998 Statham ..... 66/176
5,735,145 A * 4/1998 Pernick ..... 66/196
5,896,758 A * 4/1999 Rock et al. ..... 66/191
5,965,223 A * 10/1999 Andrews et al. ..... 428/34.5
6,105,401 A * 8/2000 Chadeyron et al. ..... 66/195
6,634,190 B2 * 10/2003 Didier-Laurent ..... 66/196
6,755,052 B1 * 6/2004 Sytz ..... 66/196
6,779,369 B2 * 8/2004 Shepherd ..... 66/196
7,410,550 B2 * 8/2008 Sherwin ..... 156/190
7,469,563 B2 * 12/2008 Wahlgren et al. ..... 66/169 R
7,576,286 B2 * 8/2009 Chen ..... 174/117 M
7,658,087 B1 * 2/2010 McMurray et al. ..... 66/196
7,779,654 B2 * 8/2010 Garus ..... 66/195
7,849,715 B2 * 12/2010 Starbuck et al. ..... 66/171

(Continued)

*Primary Examiner* — Danny Worrell
(74) *Attorney, Agent, or Firm* — Robert L. Stearns; Dickinson Wright, PLLC

(57) ABSTRACT

A knit fabric, protective sleeve and glove constructed therefrom has three knit layers knit constructed and knit to one another in a single knitting operation to provide the fabric as a single piece of knit material. The fabric includes an outer layer, an inner layer and an intermediate layer sandwiched between the outer and inner layers. The outer layer is knit with a first yarn, the inner layer is knit with a second yarn and the intermediate layer is knit with a third yarn in looped fashion about at least some of the first and second yarns to provide an integrally knit structure having three layers knit stitched together in a single knitting process.

13 Claims, 2 Drawing Sheets

U.S. PATENT DOCUMENTS

| | | | | |
|---|---|---|---|---|
| 7,908,891 | B2 * | 3/2011 | Thompson et al. | 66/174 |
| 7,934,394 | B2 * | 5/2011 | Zhu | 66/174 |
| 7,934,397 | B2 * | 5/2011 | Zhu | 66/174 |
| 7,937,973 | B2 * | 5/2011 | Sorensen et al. | 66/196 |
| 2002/0168488 | A1 | 11/2002 | Gladfelter et al. | |
| 2004/0060328 | A1 | 4/2004 | Soeda | |
| 2004/0168479 | A1 * | 9/2004 | McMurray | 66/202 |
| 2005/0079784 | A1 | 4/2005 | Joon | |
| 2009/0019624 | A1 * | 1/2009 | Birk et al. | 2/455 |

* cited by examiner

TRI-LAYER KNIT FABRIC, THERMAL PROTECTIVE MEMBERS FORMED THEREFROM AND METHODS OF CONSTRUCTION THEREOF

CROSS-REFERENCE TO RELATED APPLICATIONS

This application claims the benefit of U.S. Provisional Application Ser. No. 61/226,350, filed Jul. 17, 2009, which is incorporated herein by reference in its entirety.

BACKGROUND OF THE INVENTION

1. Technical Field

This invention relates generally to knit fabrics, and more particularly to knit fabrics having multiple layers, thermal protective members formed therefrom and to their methods of constructions.

2. Related Art

Thermal textile members, such as blankets and sleeves, are used to prevent heat from radiating and/or conducting through the member. For example, thermal gloves are known to protect a user's hands against hot objects, and are widely used in heat treatment departments of manufacturing facilities. Further, thermal textile sleeves are known for use about exhaust pipes to prevent heat from radiating outwardly from the pipes. In addition, thermal blankets are known for covering hot objects to prevent heat from radiating outwardly from the objects, such as for parts exiting a furnace in the aforementioned heat treatment department. These are just some examples of where and how thermal blankets, sleeves and gloves are commonly used.

In order to construct the aforementioned thermal members, it is known to construct separate layers of material, such as in a knitting operation, and thereafter attached the separate layers to one another for use in a blanket form, or for subsequent processing into a sleeve or glove, for example. Although the resulting multilayer thermal member may prove useful for the intended application, the construction is typically costly due to the need to construct the layers of material separate from one another in separate manufacturing operations, followed by secondary operations to form and/or join the layers together.

SUMMARY OF THE INVENTION

A knit fabric constructed in accordance with the invention has three knit layers knit constructed and knit to one another in a single knitting operation to provide the fabric as a single piece of knit material. The fabric includes an outer layer, an inner layer and an intermediate layer sandwiched between the outer and inner layers. The outer layer has first yarns knit with one another to provide a self-sustaining knit layer, the inner layer has second yarns knit with one another to provide a self-sustaining knit layer and the intermediate layer has third yarns knit in looped fashion about at least some of the first and second yarns of the outer and inner layers. Accordingly, the knit fabric provides an integrally knit structure having three layers knit stitched together in a single knitting process to provide an effective barrier to heat and abrasion, while also being economical in manufacture.

In accordance with another aspect of the invention, the outer, intermediate and inner layers are knit with different types of yarn to provide the separate layers with different performance attributes.

In accordance with another aspect of the invention, the outer, intermediate and inner layers are knit with different stitch types to provide the separate layers with different performance attributes.

In accordance with another aspect of the invention, a method of constructing a fabric having three layers of yarn is provided. The method includes knitting an outer layer having an exposed outer surface; knitting an inner layer having an exposed inner surface, and knitting an intermediate layer sandwiched between the outer and inner layers simultaneously with one another on a single knitting machine.

In accordance with another aspect of the invention, the method further includes interlocking knit stitches of yarn from the intermediate layer with knit stitches of yarn in the outer and inner layers.

In accordance with another aspect of the invention, the method further includes knitting the outer, intermediate and inner layers with different types of yarn to provide the separate layers with different performance attributes.

In accordance with another aspect of the invention, the method further includes knitting the outer, intermediate and inner layers with different stitch types to provide the separate layers with different performance attributes.

In accordance with another aspect of the invention, the method further includes forming the tri-layer knit fabric into a protective tubular sleeve.

In accordance with another aspect of the invention, the method further includes forming the tri-layer knit fabric into a protective glove.

In accordance with another aspect of the invention, a thermal protective glove is provided. The glove has an outer layer knit from a first yarn, an inner layer knit from a second yarn separate from said first yarn, and an intermediate layer sandwiched between the outer and inner layers, wherein the intermediate layer is knit from a third yarn. The third yarn is knit to loop about at least some of the first and second yarns to attach the outer layer to the inner layer via the intermediate layer.

In accordance with another aspect of the invention, a method of constructing a tri-layer knit fabric is provided. The method includes knitting an outer layer from a first yarn; knitting an inner layer knit from a second yarn separate from the first yarn, and knitting an intermediate layer sandwiched between the outer and inner layers from a third yarn separate from the first and second yarns. The method further includes knitting the outer, inner and intermediate layers simultaneously and to one another on a single knitting machine.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
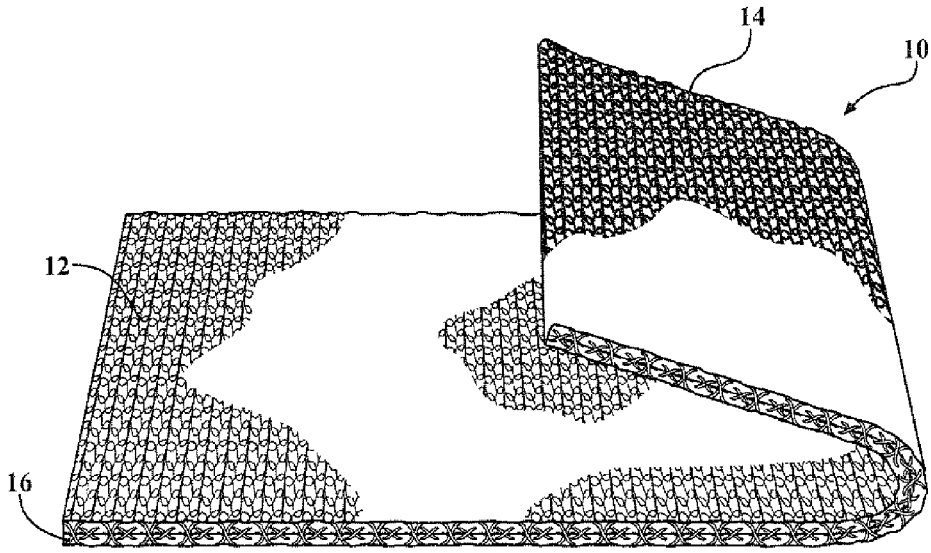
FIG. 1 illustrates a swatch of fabric knit in accordance with one aspect of the invention folded back upon itself.
Figure 2:
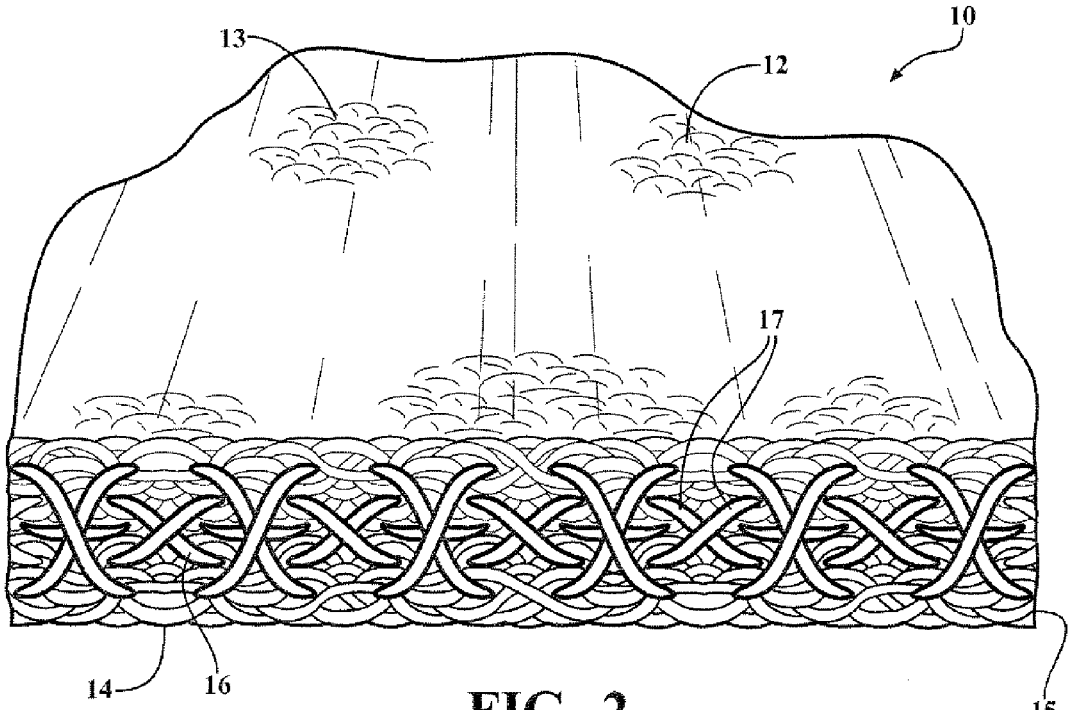
FIG. 2 shows an enlarged partial view of the swatch of fabric of FIG. 1.

Referring in more detail to the drawings, FIGS. 1 and 2 illustrate a fabric 10 knit in accordance with one presently preferred aspect of the invention. The fabric 10 has three knit layers, and thus, is also referred to as a tri-layer knit fabric, including a knit outer layer 12, a knit inner layer 14 and a knit intermediate layer 16. The intermediate layer 16 is sandwiched in abutment between the outer and inner layers 12, 14. The three layers 12, 14, 16 are constructed simultaneously in a single knitting operation, thereby providing economical benefits, including, by way of example, minimizing the number of operations, time, knitting machines and floor space, in manufacture of the fabric 10. The outer layer 12 has yarns 13 knit with one another via knit stitches to provide a self-sustaining knit layer, the inner layer 14 has yarns 15 knit with one another via knit stitches to provide a self-sustaining knit layer and the intermediate layer 16 has yarns 17 knit via knit stitches with at least some of the yarns 13 of the outer layer 12 and with at least some of the yarns 15 of the inner layer 14. Accordingly, the knit fabric 10 provides an integrally knit structure having three layers knit stitched together in substantially uniform relation over the entire area of the fabric 10 such that the three layers 12, 14, 16 of the fabric 10 are fixed to one another in inseparable fashion. As such, the fabric 10, aside from providing an excellent protective and thermal barrier, has excellent resistance to separation and movement of the layers 12, 14, 16 relative to one another in tension and shear.

In manufacture, the layers 12, 14, 16 are knit from any suitable size and type of yarn, including denier, diameter, multifilament, monofilament. In addition, any suitable type of knit stitch and density of stitch can be used to construct the layers 12, 14, 16. Accordingly, depending on the functional and/or aesthetic requirements properties desired, either the same or different types of yarn (e.g., monofilament, multifilament, denier, diameter, color, texture, thermal properties, abrasion resistance, physical properties) and the same or different types of knit stitches and stitch densities can be used to construct each of the layers 12, 14, 16, as desired. Accordingly, depending on the intended application, the fabric 10 can be customized to best meet the properties desired.

Figure 3:
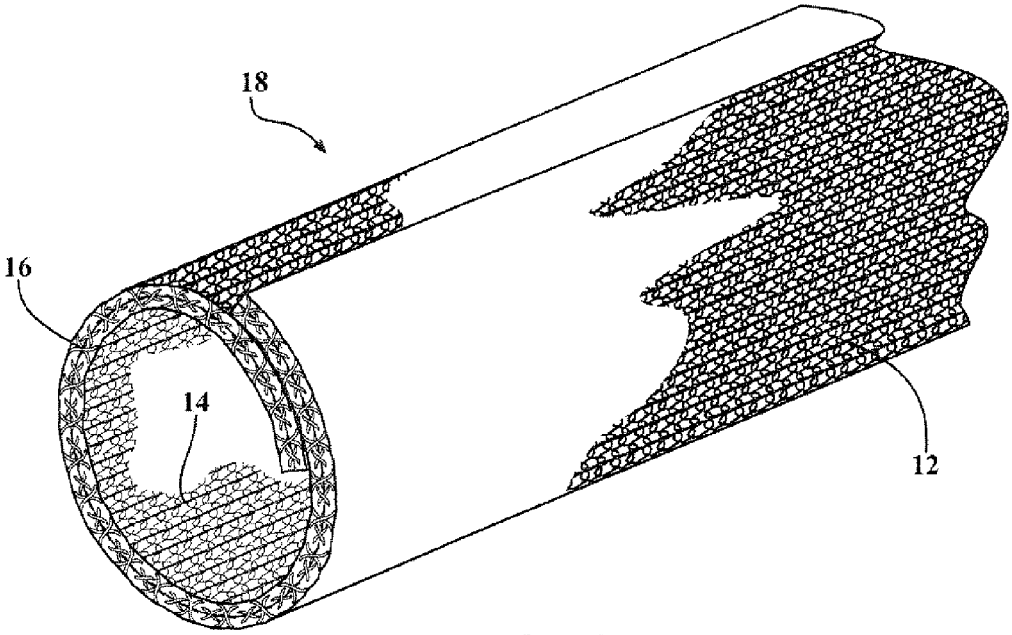
FIG. 3 shows a tubular sleeve formed using the fabric of FIG. 1.
Figure 4:
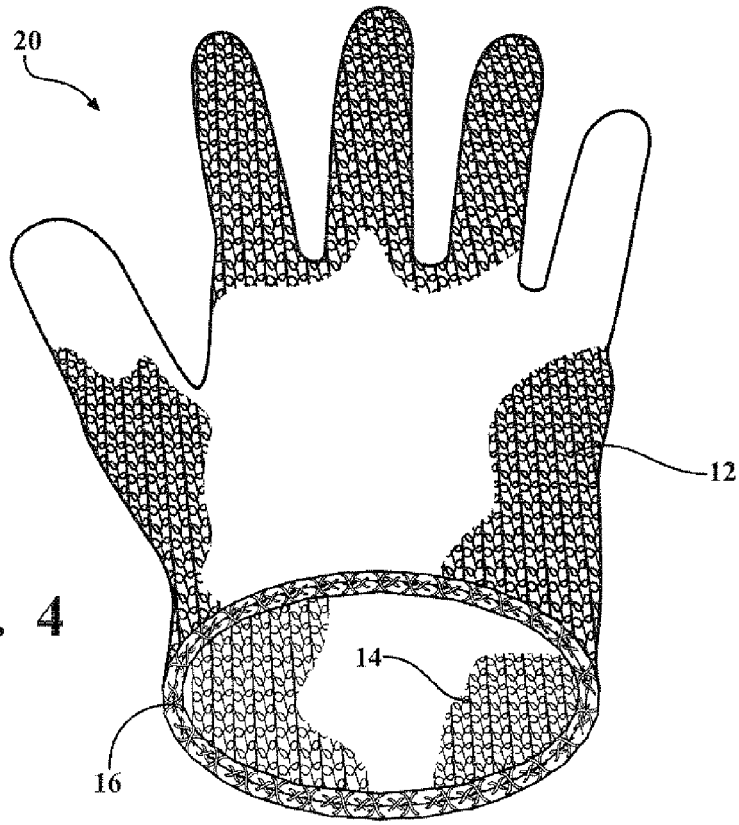
FIG. 4 shows a glove formed using the fabric of FIG. 1.

The fabric is knit using a double flatbed knitting machine (not shown), with the outer layer 12 being knit on one bed of the machine and the inner layer 14 being knit on the opposite bed of the machine, wherein the beds converge toward one another. Meanwhile, the intermediate layer 16 is knit via both beds of the machine simultaneously with the outer and inner layers 12, 14. The outer layer 12 is knit having one selected knit stitch pattern from one yarn, while the inner layer 14 is knit having another knit stitch pattern using another, wherein the respective knit stitch patterns and types of yarn used to construct the outer and inner layers 12, 14 can be the same, or different, depending on the properties, physical and/or aesthetic, of the outer and inner layers 12, 14 desired for the intended application. Accordingly, by way of example and without limitation, in construction of a blanket or a high temperature protective tubular sleeve 18 (FIG. 3) from the fabric 10, the exposed outer layer can be constructed having a durable knit construction from a durable yarn having high resistance to abrasion, impact damage, such as from monofilaments of PET, various nylon formulations, stainless steel, polypropylene, or other materials having high tensile strength, fatigue strength, and resistance to abrasion and impact damage. In contrast, the inner layer 14 (the layer facing the members being protected within the sleeve 18) can be constructed from a yarn having high temperature heat resistance, such as from multifilaments of basalt, silica, ceramic, stainless steel, and bi-component yarns wherein both components are high temperature resistant materials, for example. Of course, this is just one possible construction. For example, if constructing a glove 20 (FIG. 4) from the fabric 10, the inner layer 14 (the layer contacting a user's hand) can be knit from a gentle-to-touch yarn, such as polyester, cotton, or other soft-to-touch materials, while the outer layer 12 (exposed to the environment) can be constructed from a yarn having high heat resistance, such as from basalt, silica, ceramic, stainless steel, and bi-component yarns wherein both components are high temperature resistant materials. This again is just another example of how the outer and inner layers 12, 14 of the fabric 10 can be constructed.

The intermediate layer 16, unlike the outer and inner layers 12, 14, is not constructed as a self-sustaining layer. Stated another way, the outer and inner layers 12, 14, if separated from the fabric 10, would remain self-sustaining in a unitized knit stitch construction, and thus, would not unravel. However, if the outer and inner layers 12, 14 were to be separated from the intermediate layer 16, the intermediate layer 16 would not remain as a self-sustaining knit construction. This is because the yarns of the intermediate layer 16 are looped about selected yarns of the outer and inner layers 12, 14 using a tuck stitch, and thus, without the yarns of the outer and inner layers 12, 14, the intermediate layer 16 would come unraveled. As with the outer and inner layers 12, 14, the yarn used to form the intermediate layer 16 can be selected from any type (monofilament/multifilament), size (denier/diameter) and material of yarn (material type, texture and color) desired, depending on the application. Generally, aside from attaching the outer and inner layers 12, 14 together, the intermediate layer acts as an insulation layer, thereby providing a barrier to conduction, radiation, as well as to debris and other forms of contamination.

Obviously, many modifications and variations of the present invention are possible in light of the above teachings. It is, therefore, to be understood that within the scope of the appended claims, the invention may be practiced otherwise than as specifically described.

What is claimed is:

1. A knit fabric, comprising:

an outer layer knit from a first yarn;

an inner layer knit from a second yarn;

an intermediate layer sandwiched between the outer and inner layers, said intermediate layer being knit from a third yarn, said third yarn being knit to loop about at least some of said first and second yarns to attach said outer layer and said intermediate layer to opposite sides of said intermediate layer;

wherein said intermediate layer is knit with tuck stitches that unravel absent the outer and inner layers and said outer and inner layers are knit with self-sustaining knit stitches that do not unravel when separated from said intermediate layer; and wherein said knit fabric is formed into a protective sleeve having opposite lengthwise extending edges configured to be wrapped in overlapping relation with one another.

2. The knit fabric of claim 1 wherein each of said outer layer, said inner layer and said intermediate layer is knit using different knit stitches.

3. The knit fabric of claim 1 wherein each of said first yarn, second yarn and third yarn is a different type of yarn.

4. A thermal protective glove, comprising:

an outer layer knit from a first yarn;

an inner layer knit from a second yarn separate from said first yarn;

an intermediate layer sandwiched between the outer and inner layers, said intermediate layer being knit from a third yarn, said third yarn being knit to loop about at least some of said first and second yarns to attach said outer layer to said inner layer via said intermediate layer; and wherein said intermediate layer is knit with tuck stitches that unravel absent the outer and inner layers and said outer and inner layers are knit with self-sustaining knit stitches that do not unravel when separated from said intermediate layer.

5. The thermal protective glove of claim 4 wherein each of said outer layer, said inner layer and said intermediate layer is knit using different knit stitches.

6. The thermal protective glove of claim 4 wherein each of said first yarn, second yarn and third yarn is a different type of yarn.

7. The thermal protective glove of claim 6 wherein said first yarn is a high temperature resistant yarn and said second yarn is a soft-to-touch yarn.

8. The thermal protective glove of claim 7 wherein said first yarn is selected from the group consisting of: basalt, silica, ceramic, stainless steel, and bi-component yarns wherein both components are high temperature resistant materials.

9. A method of constructing a tri-layer knit fabric, comprising:

knitting an outer layer from a first yarn;

knitting an inner layer knit from a second yarn separate from the first yarn; and knitting an intermediate layer sandwiched between the outer and inner layers from a third yarn separate from the first and second yarns; and knitting the outer, inner and intermediate layers simultaneously and to one another on a single double flatbed knitting machine.

10. The method of claim 9 further including knitting the intermediate layer using tuck stitches about the first and second yarns.

11. The method of claim 9 further including knitting each of the outer, inner and intermediate layers having different knit stitches.

12. The method of claim 9 further including forming the fabric into a tubular protective sleeve.

13. The method of claim 9 further including knitting the fabric into a glove.

* * * * *